United States Patent [19]

Cutter

[11] 4,194,453

[45] Mar. 25, 1980

[54] SAFE DEPOSIT BOX NESTS AND METHOD OF CONSTRUCTING SAME

[75] Inventor: Larry I. Cutter, Cedar Rapids, Iowa

[73] Assignee: Walter Kidde & Company, Inc., Clifton, N.J.

[21] Appl. No.: 858,740

[22] Filed: Dec. 8, 1977

[51] Int. Cl.[2] ..... E05G 1/08

[52] U.S. Cl. ..... 109/56; 109/77; 109/79; 312/111

[58] Field of Search ..... 109/53, 56, 57, 58, 109/74, 77, 78, 79; 312/107, 111, 199, 257 R, 257 SM

[56] References Cited

U.S. PATENT DOCUMENTS

| | | | |
|---|---|---|---|
| 1,421,770 | 7/1922 | Freyberg et al. . | |
| 1,491,786 | 4/1924 | Bruckshaw et al. | 109/56 |
| 1,624,305 | 4/1927 | Anderson | 109/56 |
| 1,642,533 | 9/1927 | Beer . | |
| 1,644,215 | 10/1927 | Wilhelm . | |
| 1,756,945 | 5/1930 | Hammer . | |
| 1,874,696 | 8/1932 | Cole . | |
| 2,775,947 | 1/1957 | Mosler | 109/47 |
| 3,371,627 | 3/1968 | Belew | 109/53 |
| 3,529,879 | 9/1970 | Priest | 312/111 |
| 3,837,299 | 9/1974 | McClellan | 109/56 |
| 3,871,283 | 3/1975 | John | 109/56 |
| 3,970,010 | 7/1976 | Cantley | 109/56 |
| 4,073,554 | 2/1978 | Oder et al. | 312/199 |

*Primary Examiner*—David H. Corbin

*Attorney, Agent, or Firm*—Haven E. Simmons; James C. Nemmers

[57] ABSTRACT

A safe deposit box nest includes an outer housing into which are assembled a number of sheet metal partitions and shelves to form compartments. In order to eliminate the need for individually fitting each compartment door, each such door is hinged to and strikes against posts formed by extruded members such as aluminum attached to the front of the partitions. To the same end the forward edges of the shelves are disposed between the posts and doors and are folded rearwardly upon themselves and compressd to form shelf edge portions of uniform thickness. Finally, the nest is constructed in a manner which reduces welding to a minimum and helps insure accurate and uniform compartment openings to which the doors are applied.

6 Claims, 9 Drawing Figures

SAFE DEPOSIT BOX NESTS AND METHOD OF CONSTRUCTING SAME

BACKGROUND OF THE INVENTION

Safe deposit box nests typically are available in various compartment sizes to accommodate safe deposit boxes of different dimensions insofar as their height and width are concerned. But basically each nest is usually formed within a standard sized outer housing, a number of which are stacked together to form overall banks of boxes of varying sizes. For instance, some housings might each contain 30 compartments 2 inches high and 10 inches wide, some 24 compartments 5 inches high and five inches wide, others 21 compartments 3 inches high and 10 inches wide, still others 60 compartments 2 inches high and 5 inches wide, and so on. In order to keep manufacturing costs within reason, obviously it is necessary that the compartment construction and arrangement within each housing be as modular as possible. This in turn requires designs that allow the interior of each housing to be assembled from parts which differ from each other as little as possible and which are also as rudimentary as possible. At the same time, the need to work or rework parts individually by hand in order that they fit properly within allowed tolerances must be kept to a minimum. The goal, therefore, is a design which allows the compartments to be built up from a stock of standard, readily fabricated parts that require the least possible amount of labor to assemble in finished form.

The chief obstacle to the foregoing centers about the compartment doors themselves which must fit the fronts of the individual compartments to fairly close tolerances. While the doors alone can readily be fabricated uniformly, yet it has proven difficult to provide sufficiently uniform openings at the fronts of the compartments with the consequence that the doors must be individually fitted by hand, not just once but often several times. There are several reasons for this. In the first place, the compartments are typically formed by a number of horizontal shelves between which are vertical partitions. The shelves are usually plate or sheet material so that their spacing and thickness determine the height of the doors. But the thickness of such material varies enough so that the height of the front openings of the compartments is not sufficiently uniform. Hence, each door must be fitted for height to its individual compartment.

In the second place, the doors are typically hinged to and strike against upright members which form front side edges of the compartments, the partitions which are normally sheet material extending rearwardly from the upright members. In order for the width of the compartments to be uniform, therefore, cross-sectional variations in the upright members must be minimal and their lateral spacing must be accurate. Then, usually, the hinge knuckles are separately applied to the doors and to the upright members requiring still more individual fitting. Complicating things further is the fact that after assembly of the shelves and partitions and the fitting of the doors, every thing is normally fastened together and to the outer housing by welds. The latter produce various distortions among the parts which in turn often affects the front openings of some of the compartments and thus their doors. Hence the latter doors again must be individually refitted. In short, a great deal of painstaking hand labor is typically required to achieve a satisfactory final fit of the doors, and since each door is individually fitted, interchangeability of doors is impossible.

The primary objects of the present invention are therefore to provide a safe deposit box nest construction and a method of accomplishing same in which the need for individual hand-fitting of the doors is eliminated and in which the number of parts necessary to construct nests of differing compartment size is reduced.

SUMMARY OF THE INVENTION

The objects of the invention are achieved by several basic departures from traditional practice in safe deposit box nest construction. The first of these is to form the upright members to which the doors are hinged and against which they strike as individual posts cut to length from long aluminum extrusions, the ends of the posts of vertically adjacent compartments butting against the shelf therebetween. Hinge knuckles are integrally formed with the posts, and each vertical tier of posts is precisely located by steel bars running vertically through the posts and the shelves between them. Second, the front edge portion of the shelf between each pair of posts is formed by a rearward fold of the material upon itself to provide a uniform shelf thickness between the two posts. The foregoing are then employed with a mode of construction in which the outer housing consists essentially of two parts. The first of these is a rectangular "frame" which ultimately forms the forward edge portion of the housing. The manner in which that "frame", together with the posts, partitions and shelves, is assembled results in the "frame" in effect enveloping the posts and the folded shelf edges. The remaining part constitutes the housing bottom, side, top and rear walls.

The use of aluminum extruded posts is important for several reasons. The traditional equivalents of the posts have been uprights of long lengths of formed sheet metal running through the shelves the full height of the housing or as short lengths of same disposed between the shelves. Traditionally also, the hinge knuckles have been separately fashioned from brass, which has to be machined, and then screwed or riveted to the uprights. Extrusions, on the other hand, can be held to very close tolerances so that no final machining or other reworking is necessary to achieve the right fit and size. But brass cannot readily be extruded to close tolerances and because of its abrasive characteristics tool life would be short anyway. Aluminum, however, is ideally suited to being extruded so that long bars of correct and accurate cross-section can be turned out and then cut up into proper lengths for the posts. At the same time, the post hinge knuckles can be formed integrally with the posts, the latter tumbled to remove burrs and sharp edges and finally anodized to appropriate color. The accuracy of the extruded posts, plus the uniform thickness of the forward portions of the shelves owing to the folds therealong, plus the precise location of the posts by the vertical bars passing through them and the shelf folds, all enable the forward openings of the compartments to be built to a uniform size within very close tolerances. This is especially true because, in addition as previously noted, a front "frame" of the housing containing or surrounding the compartment openings is constructed during assembly of the posts, partitions and shelves, which "frame", as will be later explained, involves a minimum of welding, none of which can warp or affect the size of the compartment openings. Consequently, there is no need to fit the doors individually to the compartments even once, let alone several times. Instead, all the doors can be made to a uniform finished size initially with assurance that they will fit any compartment without need for individual reworking. Hence the amount of labor, particularly hand labor, and thus the cost both of labor and material is greatly reduced for a safe deposit box nest constructed according to the present invention.

Other and further features and advantages of the present invention will become apparent from the drawings and the more detailed description which follows.

DETAILED DESCRIPTION OF THE PREFERRED EMBODIMENTS

Figure 1:
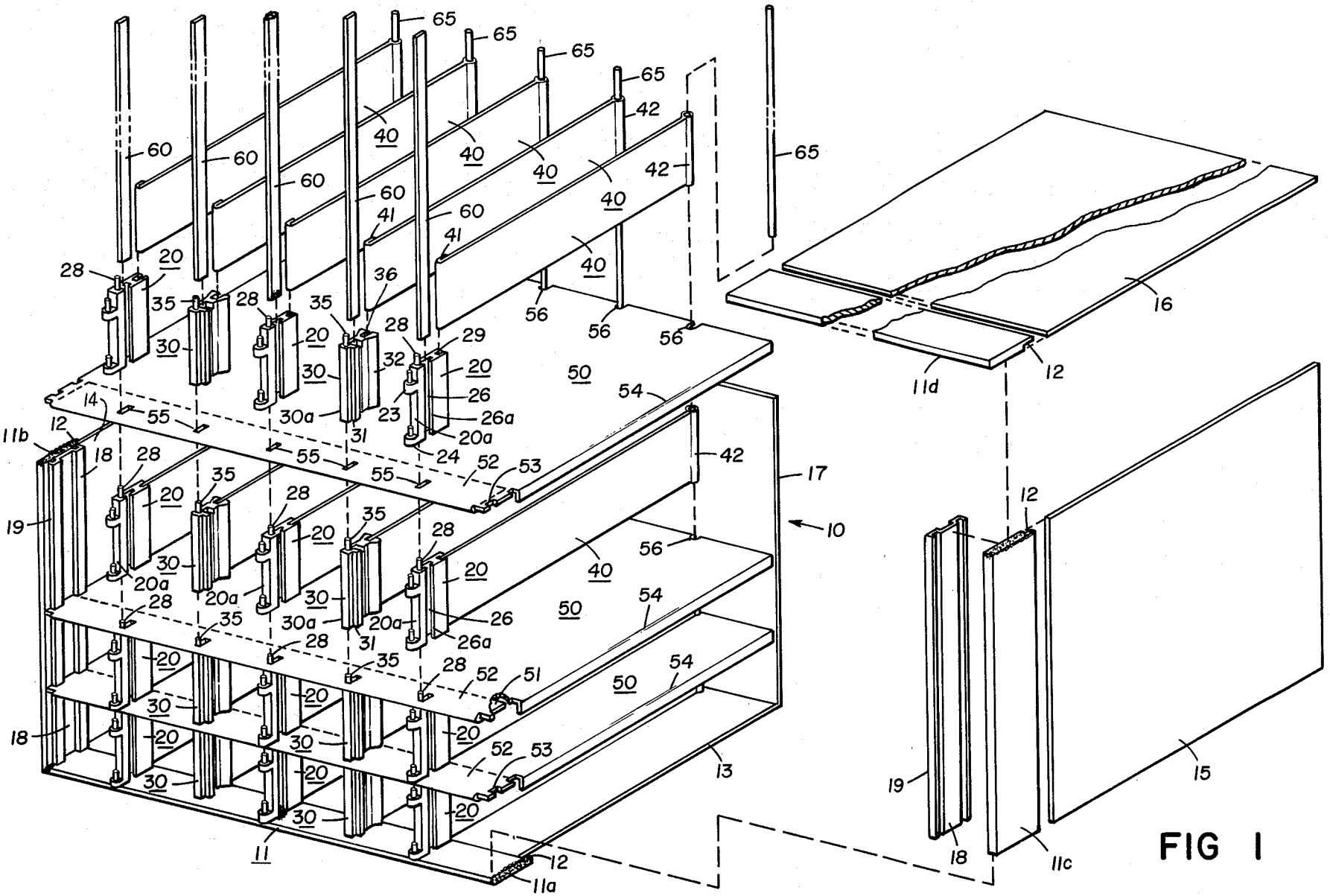
FIG. 1 is a partially exploded, isometric view of a safe deposit box nest constructed according to the invention but with the compartment doors omitted.
Figure 7:
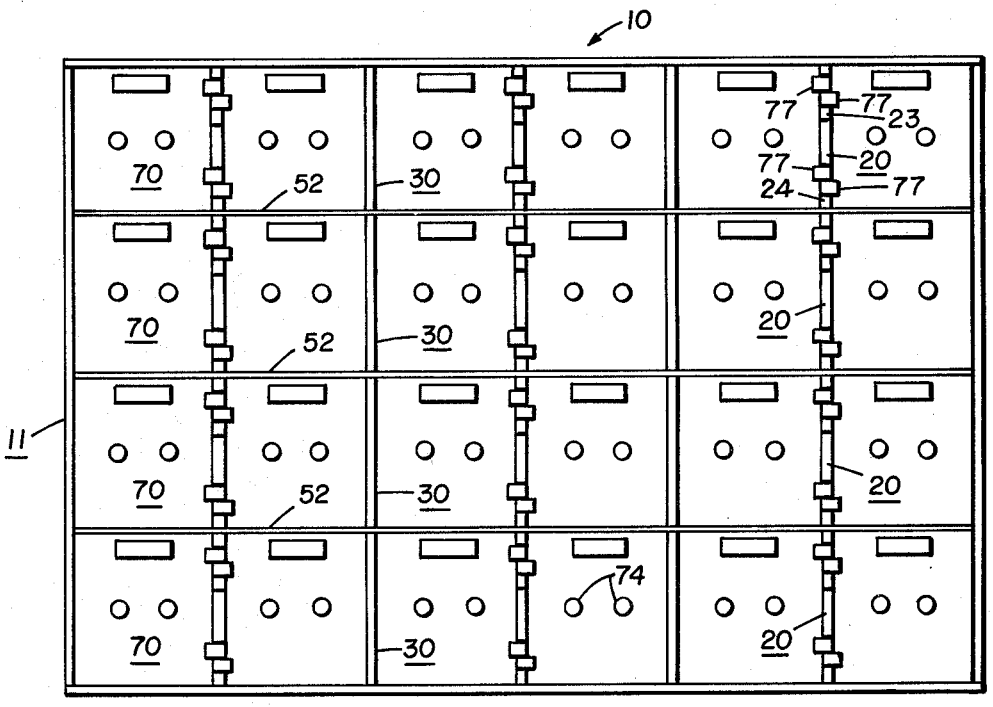
FIG. 7 is a front elevational view of the nest of FIG. 1 with the compartment doors in place.

As noted, each safe deposit box nest 10 is built up within a standard size outer housing, numbers of which are arranged together side-by-side and/or upon each other to form an overall bank of compartments of one or several modular dimensions each. In FIGS. 1 and 7, for instance, the nest 10 consists of four tiers of compartments, each of which consists in turn of six side-by-side compartments, all of the compartments being identical in size. Exteriorly, the nest 10 comprises a forward rectangular frame 11 made up from four lengths of flat bar stock 11*a*, 11*b*, 11*c*, and 11*d*. The rear inner edges of the latter are rabbetted at 12 to receive the forward edges of bottom, side and top plates 13, 14, 15 and 16, the rear of the nest 10 being closed by a back plate 17 overlapping the rear edges of the plates 13–16 which in turn overlap each other. The rabbets 12 are such that the outer faces of the frame 11 stand proud of those of the plates 13–16 while their respective inner faces are flush with each other. To the inner faces of the upright frame members 11*b* and 11*c* are secured a pair of nosings 18, of a somewhat upturned, hat-shaped cross-section, whose forward edges form door strikes 19 disposed rearwardly of the forward edges of the frame members 11*b* and 11*c* a distance equal to the thickness of the compartment doors later described.

Figure 2:
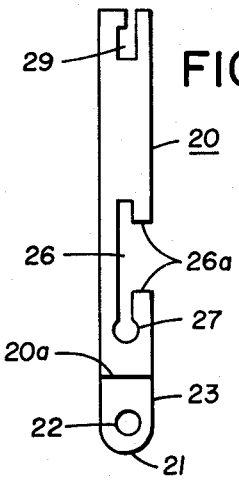
FIG. 2 is an end view of one of the three configurations of posts employed in the construction of a nest according to the invention.
Figure 3:
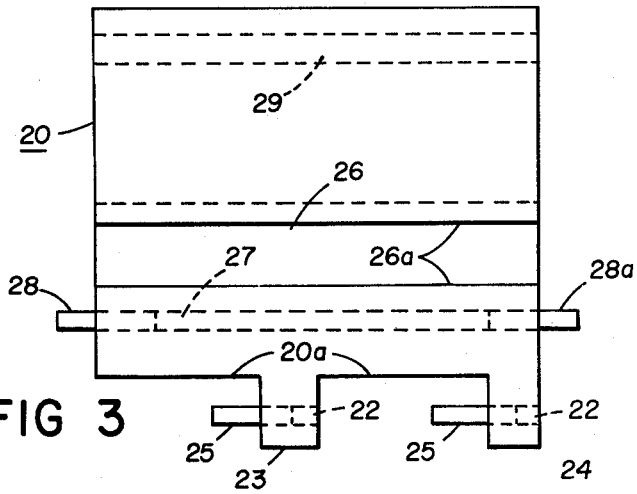
FIG. 3 is a side view of the post of FIG. 2.
Figure 4:
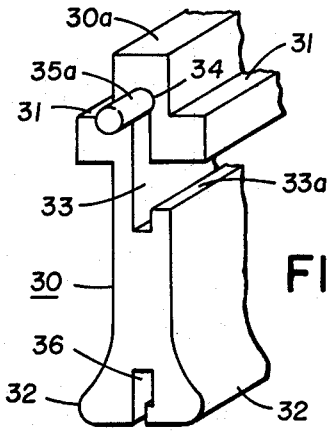
FIG. 4 is an isometric view of a second configuration of posts employed in the construction of a nest according to the invention.

Referring now to FIGS. 2, 3 and 4 in addition to FIGS. 1 and 7, the essential constituents of the interior of the nest 10 consist of posts 20 and 30, partitions 40 and shelves 50. As mentioned, the posts 20 are cut to length, namely, the height of each compartment, from long aluminum extrusions. Grade 6061-T6 aluminum has proved suitable. Each post 20 is of overall uniform thickness having a radiused nose 21 which is longitudinally drilled at 22. The nose 21 is then relieved at appropriate locations to form upper and lower integral hinge knuckles 23 and 24, separated by a rear-set face 20*a*, into whose bores 22 are pressed hinge pins 25. A squat T-shaped slot 26 extruded longitudinally through the entire length of the post 20 opens at 26*a* in turn through one flank as shown in FIGS. 2 and 3. The forward end of the slot 26 is circularly enlarged at 27 into the upper end of which is pressed a post locating pin 28. The rear edge of the post 20 is provided with an extruded longitudinal retaining slot 29 having an inner offset enlargement as shown in FIG. 2. The posts 30 are also cut to the same length as the posts 20 from long aluminum extrusions. However, each post 30 (see FIG. 4) is somewhat cruciform in cross section to provide a pair of door strikes 31 on its opposite flanks disposed rearwardly of the front face 30*a* of the post 30 a distance equal to the thickness of the compartment doors later described. The rear portions of the two flanks are splayed and radiused to form box guide noses 32 flush with the outer reaches of the strikes 31. A similar T-shaped slot 33 extruded longitudinally through the post 30 opens at 33*a* through one flank and is circularly enlarged at its forward end 34 into the upper end of which is pressed a post locating pin 35. The rear end of the post 30 is likewise formed with an offset retaining slot 36 identical to the retaining slot 29 of the posts 20, and the depths of the posts 20 and 30 from faces 20*a* and 30*a* are equal.

The rectangular partions 40 are formed from suitable sheet metal and of the same height as the posts 20 and 30. The forward edge of each partition 40 is reversely folded to form a bead 41, which slidably interlocks with the rear retaining slots 29 and 36 of the posts 20 and 30, while the rear edge is rolled to form an "eye" 42. The rectangular shelves 50 are also formed from suitable sheet material, the forward edge of each shelf 50 being reversely folded at 51 upon itself to provide a ledge 52 of uniform thickness to very close tolerances and of a depth equal to the aforesaid depths of the posts 20 and 30. The forward corners of the shelves 50 are contour punched at 53 to fittingly abut the nosings 18 while their side edges are downwardly flanged at 54 to lie against the inner faces of the side plates 14 and 15. The ledges 52 of the shelves 50 are punched at spaced locations according to the spacing of the posts 20 and 30 with rectangular slots 55 identical to the post slots 26 and 32 while the rear edges of the shelves 50 are punched with likewise spaced U-shaped notches 56 having the same radius as that of the interior of the partition eyes 42.

When a nest 10 according to the invention is assembled, the frame members 11*a*–11*d* are welded in a fixture to their respective plates 13–16 along the corners formed by the rear edges of the members 11*a*–11*d* and the outer faces of the plates 13–16. Then the assembled frame members 11*a*–11*c* and plates 13–15 are placed in a suitable jig and rigidly held in position, the nosings 18 having been previously spot welded to the side frame members 11*b* and 11*c*. The lower most tier of posts 20 and 30 are next placed in position, their lower ends having been fitted with additional post locating pins 28*a* and 35*a* which seat in spaced drillings in the bottom frame member 11*a* in order to laterally located the posts 20 and 30 accurately. The beads 41 of a set of partitions 40 are then slipped into the retaining slots 29 and 36 and the first shelf 50 then laid in position over them. The next tier of posts 20 and 30 and partitions 40 are installed, the pins 25 and 35 of the lower most tier of posts 20 and 30 locating the tier above by extending up through the shelf slots 55 and fitting into the enlargements 27 and 34 at the forward ends of the post T-slots 26 and 33. The next shelf 50 is laid down and the process repeated until the upper most tier of posts 20 and 30 and partitions 40 are in position. At this time a set of long rectangular locking bars 60, of the same cross-sectional dimensions as the slots 26 and 33 rearward of the locating pins 28, 28*a*, 35 and 35*a*, are driven down through the aligned slots 26 and 33 of the respective tiers of posts 20 and 30 and the slots 55 of the shelves 50, the lower ends of the bars 60 abutting the lower frame member 11*a* while the upper ends of the bars 60 are flush with the top of the upper most tier of posts 20 and 30. A similar set of locking rods 65 are next driven down through the respective partition eyes 42 and shelf notches 56 in order to locate the rear ends of the partitions 40. The upper frame member 11*d*, which is also provided with spaced drillings to receive the locating pins 28 and 35 of the upper most tier of posts 20 and 30, and plate 16 are then placed and held in position. The frame 11 is then compressed together and checked for accuracy. If everything is as it should be, the adjoining ends of the frame members 11*a*–11*d* are welded to each other. Then the lower and upper ends of the bars 60 (through the openings 26*a* and 33*a*), are welded to the upper and lower frame members 11*a* and 11*d* as indicated in FIG. 1, thus rigidly and accurately fixing the posts 20 and 30 in position along the shelf ledges 52. The forward corners of the shelves 50 are tack welded to the nosings 18 and their rear flanges 54 spot welded to the side plates 14 and 15, also as indicated in FIG. 1. The adjoining edges of the bottom, side and top plates 13–16 are welded to each other and finally the rear plate 17 is welded to the latter to complete the nest 10 except for the doors. Accordingly, as will be observed, since there is no welding at the front of the nest 10 except to the rigidly held frame 11, there is no opportunity for distortion of the compartment front opening to affect the fit of the doors. The compartment fronts remain uniform so that the doors can be uniformly fabricated with assurance they will all fit properly.

Figure 5:
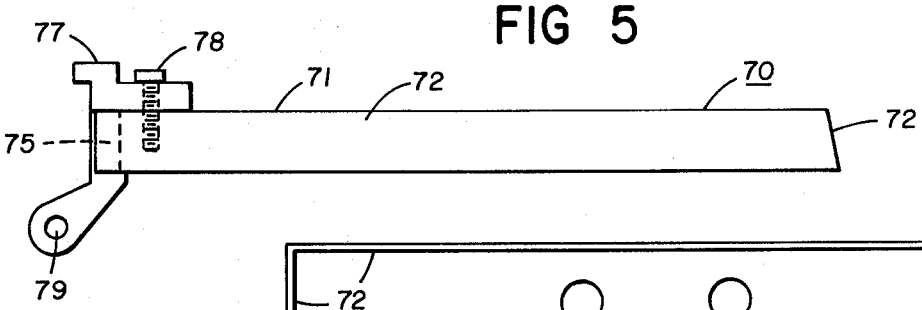
FIG. 5 is an edge view of a typical compartment door for use with the nest of the present invention.
Figure 6:
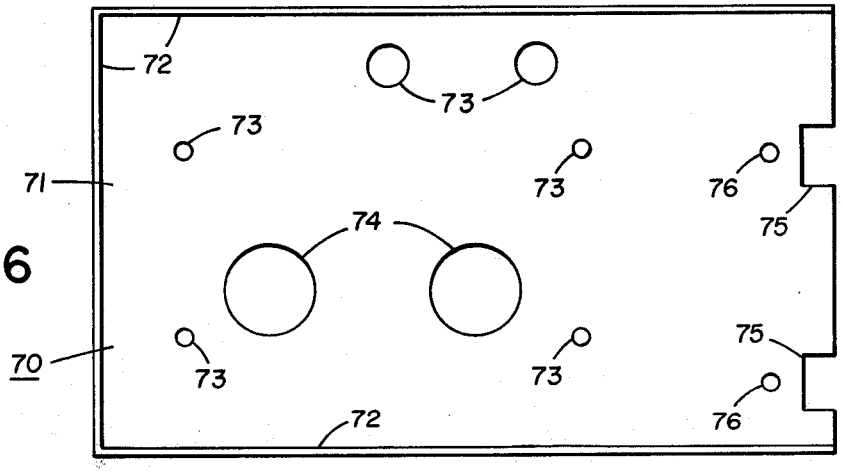
FIG. 6 is a view of the rear face of the door of FIG. 5.

The doors 70, as shown for example in FIGS. 5 and 6, are formed from suitable steel plate as blanks 71 and beveled rearwardly along their top, bottom and free edges at 72. The rear faces of door blanks 71 are appropriately drilled at 73 for mounting their locks (not shown) whose noses open forwardly from bores 74 through the blanks 71. The hinged edges of the blanks 71 are suitably notched at 75 and drilled at 76 to receive hinge knuckles 77, secured by screws 78, which are bored at 79 to slip down over the hinge pins 25 of the post 20. However, as will be observed from FIG. 7, each pair of doors 70 hinged to a post 20 are formed as mirror images of each other, and in addition, the hinge knuckles 77 of one of the two doors 70 are offset relative to those of the other. Hence, the location of the hinge knuckle notches 75 along the door blanks 71 must be different from the doors 70 to the right of the post 20 than it is for those to the left.

Figure 9:
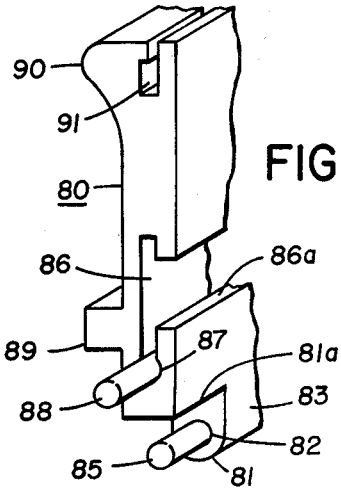
FIG. 9 is an isometric view of the third configuration of posts employed in the nest of FIG. 8.
Figure 8:
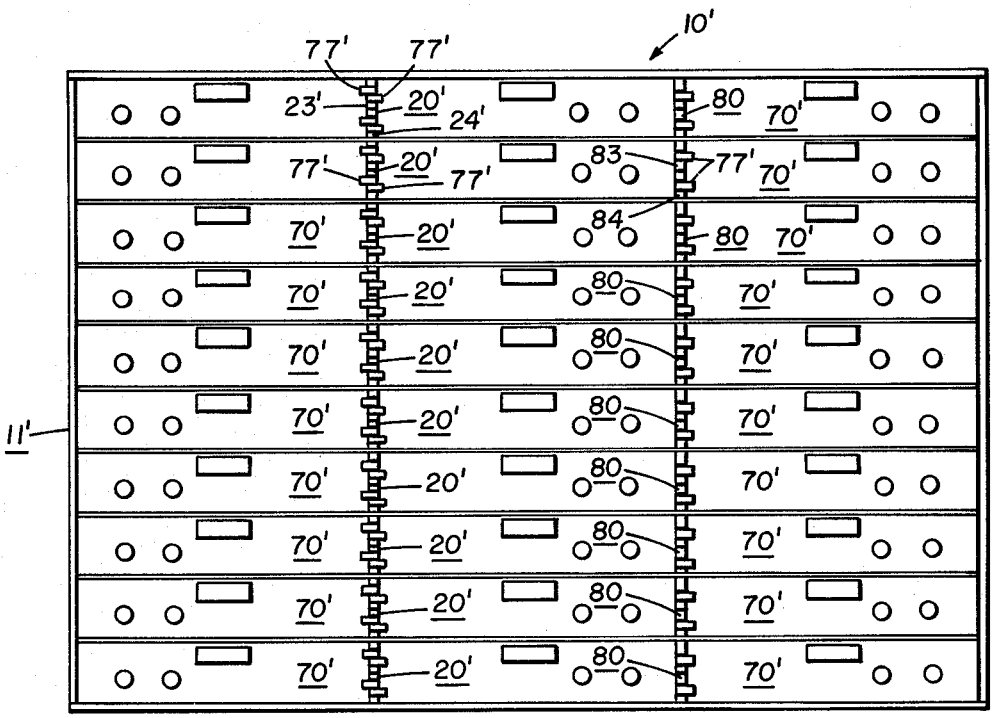
FIG. 8 is a front elevational view of a nest constructed according to the invention but having compartments of different height and width from those of the nest of FIG. 1.

It will be apparent that different numbers and sizes of compartments can be provided within the same overall size of a nest 10. This is readily accomplished, according to the construction of the invention, by increasing or decreasing the heights of the posts 20 and 30 and/or varying their spacing to form other modular arrangements of compartments. Different heights of posts 20 and 30 are easily accommodated since both are cut to length from long uniform extrusions. The partitions 40, except for their number and height, and the shelves 50, except also for their number and the spacing of their slots 55 and notches 56 to accommodate different compartment widths, remain the same as do essentially all other components. The technique of assembly is also identical. Only in those cases in which a post must provide for a door hinge on one side and a door strike on the other, rather than two hinges or two strikes, is an additional component required. Such as instance is illustrated in FIG. 8 in the case of a nest 10′ and frame 11′ of identical overall dimensions but divided into a greater number of tiers of wider but shallower compartments than the nest 10. In the nest 10′ the posts 20′ are identical, except for height, to the posts 20 of the nest 10 but the posts 80 differ from the posts 30 as shown in detail in FIG. 9, being an amalgamation of the posts 20 and 30. Each post 80 is also cut from long aluminum extrusions and includes a rounded front nose 81 which is longitudinally drilled at 82. The nose 81 is relieved at 81*a* to provide hinge knuckles 83 and 84 which are fitted with hinge pins 85 in the bores 82. A squat T-shaped slot 86 extends longitudinally through the post 80 and opens through one flank at 86*a*, the forward end of the slot 86 being circularly enlarged at 87 and fitted with a post locating pin 88. The other flank of the post 80 is formed with a door strike 89 and a box guide nose 90 while the rear edge includes a longitudinal offset slot 91. The nature and dimensions of the foregoing details of the posts 80 are identical to those of the respective corresponding details of the posts 20 and 30 so that all three are interchangeable with each other insofar as their fit and assembly with the other components are concerned. From the foregoing it will be apparent to those skilled in the art that other nests, identical in overall dimensions with the nests 10 and 10′ but having compartments of other combinations of width and height, may be constructed in the manner and with the components of the invention. Furthermore, if desired, the side and rear plates 14,15 and 17 can take the form of a U-shaped bending from a single piece of material, and the bottom and top plates 13 and 16 in turn can be formed as shallow pans, open at their fronts, whose side and rear walls exteriorly overlap and are welded to the corresponding side and rear walls of the bending.

Though the present invention has been described in terms of particular embodiments, being the best mode known of carrying out the invention, it is not limited to those emobodiments alone. Instead, the following claims are to be read as encompassing all modifications and adaptations of the invention falling within its spirit and scope.

I claim:

1. In safe deposit box nest construction incorporating one or more modular assemblies, each assembly including: an outer rectangular housing having an open front and top, bottom, side and rear walls and forward framing having bottom, side and top members forming separate forward extensions of the respective housing bottom, side and top walls, the forward framing defining the front of the housing; the housing containing a plurality of laterally and vertically adjacent safe deposit box compartments extending from the housing rear wall and opening through the front of the housing; the compartments being at least partially formed first by a plurality of parallel horizontally spaced vertical posts and separate partitions with the partitions extending rearwardly from the posts, the posts and partitions being divided into laterally spaced sets thereof with the posts and partitions of each set being in vertical alignment, and second by one or more parallel vertically spaced horizontal shelves of metallic sheet material, the posts and shelves forming forward edge portions of the compartments with each of the shelves extending between and separating vertically adjacent posts and partitions; and doors closing the fronts of the compartments, each door being hinged about a vertical axis to one of the posts, the improvement comprising: an extruded metallic member of uniform cross-section forming each post, the posts of each set thereof including integrally formed vertically aligned first channels longitudinally therethrough disposed between forward and rearward edge portions of said posts and integrally formed vertically aligned second channels longitudinally therethrough disposed rearwardly of the first channels and opening through the rear of said posts, the partitions associated with said set of posts having integrally formed forward edge portions slidably receivable in interlocking engagement with the second channels; a fold of said sheet material rearwardly upon itself of uniform thickness and forming the forward edge portion of each shelf, vertically adjacent posts and doors being separated by said folds; a post locating member slidable in and extending through the first channels and the folds of the shelves, the first channels and the post locating members providing an interlocking engagement therebetween effective to locate the posts of each set thereof against movement relative to the shelves without the need of additional fastening means between the posts and the post locating members, the uppermost and lowermost ends of the posts of each set butting against the top and bottom framing members respectively; and means securing the uppermost and lowermost ends of the post locating members to the top and bottom framing members.

2. The construction of claim 1 wherein said first channels open laterally through one side of the posts, and wherein said securing means comprises welds disposed in said first channels.

3. The construction of claim 2 wherein a rearward edge portion of each set of partitions include integrally formed vertically aligned third channels to slidably receive in interlocking engagement therewith a partition locating member extending through said third channels and the rear edge portions of the shelves.

4. The construction of claim 1 wherein a front portion of each post of a first group of said sets of posts includes a forwardly extending pair of vertically spaced hinge knuckles integrally formed with said post, said pair of knuckles having a pair of vertically aligned upstanding hinge pins fixed therein hingedly receiving a complementary pair of hinge knuckles provided on one of the doors.

5. The construction of claim 4 wherein each post of a second group of said sets of posts is provided with a pair of integrally formed, vertical forward faces extending laterally from respective opposite sides of said post and forming strikes for a pair of the doors, said pair of strikes being laterally opposite respective pairs of the hinge knuckles.

6. The construction of claim 4 wherein each post of one of said sets of posts in said first group thereof is also provided with an integrally formed vertical forward face extending laterally from one side of said post and forming a strike for one of the doors, said strike being laterally opposite one pair of the hinge knuckles.

* * * * *